US007935009B2

(12) United States Patent
Mullin

(10) Patent No.: US 7,935,009 B2
(45) Date of Patent: May 3, 2011

(54) SYSTEM FOR PICKING UP, TOSSING, AND STRIKING A BALL

(75) Inventor: Keith Alan Mullin, La Jolla, CA (US)

(73) Assignee: Make Ideas, Inc., La Jolla, CA (US)

( * ) Notice: Subject to any disclaimer, the term of this patent is extended or adjusted under 35 U.S.C. 154(b) by 0 days.

(21) Appl. No.: 12/762,160

(22) Filed: Apr. 16, 2010

(65) Prior Publication Data

US 2010/0197429 A1 Aug. 5, 2010

Related U.S. Application Data

(63) Continuation of application No. 12/110,074, filed on Apr. 25, 2008, now abandoned, and a continuation of application No. 12/105,263, filed on Apr. 17, 2008, now abandoned.

(60) Provisional application No. 60/994,180, filed on Sep. 18, 2007, provisional application No. 61/045,607, filed on Apr. 16, 2008, provisional application No. 60/925,010, filed on Apr. 17, 2007, provisional application No. 60/994,180, filed on Sep. 18, 2007, provisional application No. 61/045,607, filed on Apr. 16, 2008.

(51) Int. Cl.
*A63B 69/00* (2006.01)

(52) U.S. Cl. ..... 473/457; 473/422; 473/451

(58) Field of Classification Search ..... 473/422, 473/451, 457, 513, 517, 558–568, 509, 510, 473/553, 524, 235, 286; D21/723, 725, 722, D21/780

See application file for complete search history.

(56) References Cited

U.S. PATENT DOCUMENTS

| | | | | |
|---|---|---|---|---|
| 755,117 | A | 3/1904 | Dunn | |
| 838,257 | A | 12/1906 | Kinst | |
| 930,918 | A * | 8/1909 | Barry | 473/509 |
| 1,535,029 | A | 4/1925 | Murch | |
| 1,582,811 | A * | 4/1926 | Adler | 473/509 |
| 1,593,577 | A | 7/1926 | Kaiser | |
| 1,674,294 | A | 6/1928 | O'Rourke | |
| 1,865,173 | A | 6/1932 | Dickerman | |
| 1,877,820 | A | 9/1932 | Costello | |
| 1,946,373 | A | 2/1934 | Walsh | |
| 2,135,232 | A | 11/1938 | Dawn | |
| 2,237,748 | A | 4/1941 | Schwarzenzer | |
| 2,670,958 | A | 3/1954 | Leiser et al. | |
| 2,710,753 | A | 6/1955 | Lockwood | |
| 2,935,323 | A | 5/1960 | Cummings | |
| 3,048,399 | A | 8/1962 | Breitbach | |
| D194,045 | S | 11/1962 | Hasselbusch | |
| 3,111,314 | A | 11/1963 | Topper | |
| 3,115,129 | A | 12/1963 | Merriman | |

(Continued)

*Primary Examiner* — Mitra Aryanpour
(74) *Attorney, Agent, or Firm* — Tillman Wright, PLLC; James D. Wright; Chad D. Tillman

(57) ABSTRACT

A multi-purpose implement is provided, including a racquet, having a handle portion and a flexible planar area held under tension by a frame, and a ball basket attached to the racquet and adapted to lift a ball directly from a generally horizontal surface. A method of using the implement, without contacting the ball with one's hands, includes holding the handle portion in one or both hands, maneuvering the ball basket into contact with a ball lying on a generally horizontal surface, lifting the ball directly from the generally horizontal surface with the ball basket, tossing the ball from the ball basket into the air, and while the ball is in the air, striking the ball with the racquet.

18 Claims, 13 Drawing Sheets

U.S. PATENT DOCUMENTS 3,120,387 A 2/1964 Weinstein
3,214,168 A 10/1965 Sauber
3,236,521 A 2/1966 Knott
3,246,894 A 4/1966 Salisbury
3,268,226 A 8/1966 Martino
3,392,978 A * 7/1968 Wiest, Jr. ..... 473/509
3,424,461 A * 1/1969 Kirk ..... 473/509
3,496,924 A * 2/1970 Miller ..... 124/5
3,529,589 A * 9/1970 Esser ..... 124/5
3,589,349 A 6/1971 Parker
3,819,179 A * 6/1974 Ambler et al. ..... 473/457
3,833,217 A 9/1974 Greaney
3,844,555 A 10/1974 Tremblay
3,874,666 A 4/1975 Ross
3,897,058 A 7/1975 Koch
3,944,225 A 3/1976 Greaney
4,052,060 A 10/1977 Balkcom
4,236,271 A 12/1980 Martino
4,352,495 A 10/1982 Marchionda
4,717,155 A * 1/1988 Chu-Hwa ..... 473/509
4,834,376 A 5/1989 Steinberg
4,863,174 A * 9/1989 Cummings ..... 473/509
4,890,846 A 1/1990 Spanski
5,024,435 A 6/1991 Robbins
5,080,371 A 1/1992 Karczewski
D325,612 S 4/1992 Longo
5,213,324 A 5/1993 Bowers
D340,752 S 10/1993 Flynn et al.
5,269,511 A 12/1993 Chavez
5,333,867 A 8/1994 DiVito
5,383,661 A 1/1995 Beck
5,388,822 A 2/1995 Cassady
5,395,107 A 3/1995 De Pippo
D358,859 S 5/1995 Bernardo
5,423,543 A 6/1995 Tarrant
5,452,891 A 9/1995 Thomas
5,501,451 A 3/1996 Slusarczyk
5,651,744 A 7/1997 Millon et al.
5,674,141 A 10/1997 Laforest
5,803,838 A 9/1998 DeMarini et al.
5,820,438 A 10/1998 Horton
5,888,154 A 3/1999 Hartman
D413,641 S 9/1999 Falco
5,947,850 A 9/1999 Gray
6,076,829 A 6/2000 Oblack
6,186,909 B1 2/2001 Swanson
6,241,629 B1 6/2001 Otto
6,241,632 B1 * 6/2001 Obsniuk ..... 473/509
6,565,462 B1 5/2003 Gregg
6,572,498 B2 6/2003 Nevers
6,626,774 B2 9/2003 Sorbie
6,719,651 B1 4/2004 Newey
6,923,738 B1 * 8/2005 Fulp ..... 473/457
6,949,036 B2 9/2005 Ciesar et al.
7,032,583 B1 4/2006 Hall
D525,670 S 7/2006 Green
7,112,153 B1 9/2006 Beu
D537,893 S 3/2007 Freeland
D539,859 S 4/2007 Eldridge
7,244,201 B2 7/2007 Hale
D585,513 S 1/2009 Scheele
2001/0034275 A1 10/2001 Dunnack et al.
2002/0072436 A1 6/2002 Liu
2003/0069095 A1 4/2003 Turos
2006/0063616 A1 3/2006 Nye et al.
2006/0094545 A1 5/2006 Blades
2007/0111830 A1 5/2007 Wright
2007/0155525 A1 7/2007 Davenport et al.
2007/0277746 A1 12/2007 Piaget
2008/0004140 A1 1/2008 Matsumoto et al.
2008/0039241 A1 2/2008 Pope
2008/0261729 A1 10/2008 Mullin
2008/0261730 A1 10/2008 Mullin
2008/0261732 A1 10/2008 Mullin
2010/0234146 A1 9/2010 Mullin

* cited by examiner

SYSTEM FOR PICKING UP, TOSSING, AND STRIKING A BALL

CROSS-REFERENCE TO RELATED APPLICATIONS

The present application is a continuation of, and claims priority under 35 U.S.C. §120 to, U.S. patent application Ser. No. 12/110,074, filed Apr. 25, 2008 (the "'074 Application"), which '074 Application is a non-provisional patent application of, and claims the benefit under 35 U.S.C §119(e) to each of:

(a) U.S. Provisional Patent Application No. 60/994,180, filed Sep. 18, 2007; and (b) U.S. Provisional Patent Application No. 61/045,607, filed Apr. 16, 2008.

In addition, the '074 application is a continuation of, and claims priority under 35 U.S.C. §120 to, U.S. patent application Ser. No. 12/105,263, filed Apr. 17, 2008 (the "'263 Application"), which '263 application is a nonprovisional patent application of, and claims the benefit under 35 U.S.C §119(e) to each of:

(a) U.S. Provisional Patent Application No. 60/925,010, filed Apr. 17, 2007;

(b) U.S. Provisional Patent Application No. 60/994,180, filed Sep. 18, 2007; and (c) U.S. Provisional Patent Application No. 61/045,607, filed Apr. 16, 2008.

The entirety of each of the foregoing applications is expressly incorporated herein by reference.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to multi-purpose ball implements, and, in particular, a system for picking up, tossing, and striking a ball in such a way that the ball does not come in contact with a user's hands.

2. Background

It can be appreciated that implements for hitting or striking a ball have been in use for years. Typically, ball strikers include, but are not limited to, baseball bats, tennis racquets, cricket bats, and the like.

One problem with most conventional implements for striking a ball is that they have no device which retains a ball, where a user can eject the ball upward in order to strike the ball without touching the ball. Several attempts have been made to solve this problem, at least with regard to baseball bats and the like, as set forth in U.S. Pat. Nos. 3,115,342, 3,169,019 and 4,930,772, but each bat disclosed therein suffers at least from the problem that the means for holding the ball and enabling it to be flipped or tossed in the air also causes interference with the proper striking of the ball; i.e., the openings or attached ball-cups cover or eliminate part of the hitting surface from proper use.

In addition, neither these implements nor any other known ball implements have a device or method or means to pick up a ball without bending down and/or touching the ball with at least one hand. Furthermore, no known implement in the form of other types of ball-striking implements, such as that of a tennis racquet or the like, has been developed.

Thus, while conventional devices may be suitable for the particular purpose to which they address, they are not suitable for persons to pick up a ball, toss a ball, and strike a ball, while not touching the ball with at least one hand.

In these respects, a system for picking up, tossing, and striking a ball in such a way that the ball does not come in contact with a user's hands, according to the present invention, substantially departs from the conventional concepts and designs of the prior art, and in so doing, provides an apparatus primarily developed for the purpose of persons to pick up, toss, and strike a ball, while not touching the ball with at least one hand.

SUMMARY OF THE PRESENT INVENTION

The present invention provides a new hands free ball pick up, toss, and strike system wherein the same can be utilized for persons to pick up, toss, and strike a ball, while not touching the ball with their hands. Broadly defined, the present invention according to at least one aspect includes a device which may be attachable to an implement used to strike a ball, or may be part of an implement used to strike a ball, that is capable of retrieving a ball from the ground, holding the ball, and facilitating tossing the ball into the air to allow the implement it is attached to or implement that it is part of, to subsequently strike the ball. In one embodiment, the device used to pick up the ball is a scoop or shovel shape. In another embodiment, the device used to pick up the ball is a press-fit ball grabber.

A purpose of the present invention, which will be described subsequently in greater detail, is to provide a new hands free ball pick, toss, and strike system that has many of the advantages of the ball-striking implements mentioned heretofore and many novel features that result in a new hands free ball pick up, toss, and strike system which is not anticipated, rendered obvious, suggested, or even implied by any of the prior art ball pick up, toss, and/or strikers, either alone, or in any combination.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description of illustrations in the drawings. The invention is capable of other embodiments and of being practiced and carried out in various ways. Also, it is to be understood that the phraseology and terminology employed herein are for the purpose of the description and should not be regarded as limiting.

One object of the present invention is to provide a system for scooping, tossing and striking a ball that will overcome the shortcomings of the prior art devices.

An objective of the present invention is to provide a system for scooping, tossing and striking a ball for persons to pick and strike a ball, while not touching the ball with their hands.

Another object is to provide a system for scooping, tossing and striking a ball that allows a user to scoop or pick up a ball from a surface without bending down.

Another objective is to provide a system for scooping, tossing and striking a ball that allows a user to pick up and subsequently hit the ball without using their hands to pickup the ball or without using their hands to toss the ball.

Another object is to provide a system for scooping, tossing and striking a ball that allows a user to strike a ball in a swing like manner, including but not limited to a baseball swing or tennis swing.

Another object is to provide a system for scooping, tossing and striking a ball that allows a user can to eject the ball in a similar manner to tossing a ball into the air for the purpose of striking the ball.

Another object is to provide a system for scooping, tossing and striking a ball that allows a user to strike the ball with the ball striking implement with the purpose of sending the ball flying various distances.

Another object is to provide a system for scooping, tossing and striking a ball where the striking implement provides a specially designed area, such as woven mesh, to strike the ball.

Other objects and advantages of the present invention will become obvious to the reader and it is intended that these objects and advantages are within the scope of the present invention.

The present invention according to a first aspect is a ball lifting, tossing and striking system by which a user can pick up, toss and strike a ball in such a way that the ball does not come in contact with the user's hands, including: a ball; and a multi-purpose implement that may be carried by a user in one or both hands, including a striking implement, having a handle portion and a striking portion, and a ball basket attached to the striking implement and adapted to lift the ball from the ground; wherein a user may grasp the striking implement, lift the ball from the ground with the ball basket, and without touching the ball with either of the user's hands, toss the ball from the ball basket into the air such that it may be struck by the striking portion.

In a feature of this aspect, the ball basket is a scoop adapted to be inserted underneath the ball to lift the ball from the ground and adapted to cradle the ball until the ball is tossed into the air. In further features, the striking implement has a generally round cross-section, the striking implement is a baseball bat; the striking implement is a paddle or woven mesh racquet; the striking implement is a tennis racquet; the striking implement has a generally rectangular cross-section; the striking implement is a cricket bat; the scoop is detachable from the striking implement; and/or the scoop is permanently attached to the striking implement.

In another feature of this aspect, the ball basket includes a press-fit ball grabber adapted to be pressed onto the ball to lift the ball from the ground and adapted to cradle the ball until the ball is tossed into the air. In further features, the press-fit ball grabber includes a ring-shaped end defining a ball inlet; the ring-shaped end snaps around the ball for the purpose of picking up the ball from the ground; the press-fit ball grabber includes a square-shaped end defining a ball inlet; the square-shaped end snaps around the ball for the purpose of picking up the ball from the ground; the ball basket further includes a side defining a ball outlet; and/or the ball basket is arranged to permit the ball to be tossed upward through the ball outlet by the user.

The present invention according to a second aspect is a multi-purpose implement, that may be carried by a user in one or both hands, for lifting, tossing and striking a ball in such a way that the ball does not come in contact with the user's hands, including: a striking portion having a proximal end and a distal end; a handle portion disposed at the proximal end of the striking portion; and a ball basket attached to the distal end of the striking portion and adapted to lift a ball from the ground; wherein a user may grasp the handle portion, lift the ball from the ground with the ball basket, and without touching the ball with either of the user's hands, toss the ball from the ball basket into the air such that it may be struck by the striking portion.

In a feature of this aspect, the ball basket is a scoop adapted to be inserted underneath the ball to lift the ball from the ground and adapted to cradle the ball until the ball is tossed into the air. In other features, the striking portion has a round cross-section; the striking portion and the handle portion together take the form of a baseball bat; the striking portion is a paddle or woven mesh racquet; the striking portion and the handle portion together take the form of a tennis racquet; the striking portion has a rectangular cross-section; the striking portion and the handle portion together take the form of a cricket bat; the scoop is detachable from the striking portion; the scoop is permanently attached to the striking portion; the handle portion is detachable from the striking portion; and/or at least a portion of the striking portion is hollow, and the handle portion may be inserted into the striking portion for storage.

In another feature of this aspect, the ball basket includes a press-fit ball grabber adapted to be pressed onto the ball to lift the ball from the ground and adapted to cradle the ball until the ball is tossed into the air. In features of this aspect, the press-fit ball grabber includes a ring-shaped end defining a ball inlet; the ring-shaped end snaps around the ball for the purpose of picking up the ball from the ground; the press-fit ball grabber includes a square-shaped end defining a ball inlet; the square-shaped end snaps around the ball for the purpose of picking up the ball from the ground; the ball basket further includes a side defining a ball outlet; and/or the ball basket is arranged to permit the ball to be tossed upward through the ball outlet by the user.

The present invention according to a third aspect is a method of lifting, tossing and striking a ball, including: providing a multi-purpose implement, including a striking implement, having a handle portion and a striking portion, and a ball basket attached to the striking implement and adapted to lift a ball directly from the ground; and without contacting the ball with one's hands, (i) holding the handle portion in one or both hands, (ii) maneuvering the ball basket beneath a ball lying on the ground, (iii) lifting the ball directly from the ground with the ball basket, (iv) tossing the ball from the ball basket into the air, and (v) while the ball is in the air, striking the ball with the striking portion.

The present invention according to a fourth aspect is a ball lifting, tossing and striking system by which a user can pick up, toss and strike a ball in such a way that the ball does not come in contact with the user's hands, including: a ball; and a multi-purpose implement that may be carried by a user in one or both hands, that includes a bat, having a handle portion and a barrel, and a ball basket attached to the bat and adapted to lift the ball from the ground; wherein a user may grasp the handle portion of the bat, lift the ball from the ground with the ball basket, and without touching the ball with either of the user's hands, toss the ball from the ball basket into the air such that it may be struck by the barrel of the bat.

In a feature of this aspect, the ball basket is a scoop adapted to be inserted underneath the ball to lift the ball from the ground and adapted to cradle the ball until the ball is tossed into the air.

In a further feature of this aspect, the striking implement is in the form of a baseball bat. In further features, the baseball bat is made at least partially from wood, at least partially from metal, and/or at least partially from plastic.

In further features of this aspect, the striking implement is a softball bat or a whiffle bat.

In a further feature of this aspect, the scoop is detachable from the bat. In a further feature, the scoop is attachable to an end of the bat via one or more half-rings extending around the circumference thereof. In another feature, one or more wires or straps are provided around the half-rings to further facilitate the attachment of the scoop to the end of the bat.

In a further feature of this aspect, the scoop is permanently attached to the bat. In a further feature, the scoop is attached to the bat via a ring, integral with the rest of the scoop, around an end of the bat.

In another feature, the handle portion of the bat is detachable from the barrel of the bat. In a further feature, at least a portion of the barrel of the bat is hollow, and the handle portion of the bat may be inserted into the barrel of the bat for storage.

The present invention according to a fifth aspect is a multi-purpose bat implement, that may be carried by a user in one or both hands, for lifting, tossing and striking a ball in such a way that the ball does not come in contact with the user's hands, including: a barrel having a proximal end and a distal end; a handle portion disposed at the proximal end of the barrel; and a ball basket attached to the distal end of the barrel and adapted to lift a ball from the ground; wherein a user may grasp the handle portion, lift the ball from the ground with the ball basket, and without touching the ball with either of the user's hands, toss the ball from the ball basket into the air such that it may be struck by the barrel of the bat implement.

In a feature of this aspect, the ball basket is a scoop adapted to be inserted underneath the ball to lift the ball from the ground and adapted to cradle the ball until the ball is tossed into the air.

In another feature of this aspect, the barrel and handle portion together are in the form of a baseball bat. In further features, the baseball bat is made at least partially from wood, at least partially from metal, and/or at least partially from plastic.

In further features, the barrel and handle portion together comprise a softball bat or a whiffle bat.

In another feature, the scoop is detachable from the barrel of the bat implement. In a further feature, the scoop is attachable to the distal end of the barrel of the bat implement via one or more half-rings extending around the circumference thereof. In a still further feature, one or more wires or straps are provided around the half-rings to further facilitate the attachment of the scoop to the distal end of the barrel of the bat implement.

In another feature, the scoop is permanently attached to the bat. In a further feature, the scoop is attached to the bat via a ring, integral with the rest of the scoop, around the distal end of the barrel of the bat implement.

In yet another feature, the handle portion of the bat is detachable from the barrel of the bat implement. In a further feature, at least a portion of the barrel of the bat implement is hollow, and the handle portion of the bat implement may be inserted into the barrel for storage.

The present invention according to a sixth aspect is a method of lifting, tossing and striking a ball, including: providing a multi-purpose implement that includes a bat, having a handle portion and a barrel, and a ball basket attached to the bat and adapted to lift a ball directly from the ground; and without contacting the ball with one's hands, holding the handle portion in one or both hands, maneuvering the ball basket beneath a ball lying on the ground, lifting the ball directly from the ground with the ball basket, tossing the ball from the ball basket into the air, and while the ball is in the air, striking the ball with the barrel of the bat.

The present invention according to a seventh aspect is a ball lifting, tossing and striking system by which a user can pick up, toss and strike a ball in such a way that the ball does not come in contact with the user's hands, including: a ball; and a multi-purpose implement that may be carried by a user in one or both hands, that includes a tennis racquet and a ball basket attached to the tennis racquet and adapted to lift the ball from the ground; wherein a user may grasp a handle portion of the tennis racquet, lift the ball from the ground with the ball basket, and without touching the ball with either of the user's hands, toss the ball from the ball basket into the air such that it may be struck by the striking portion of the tennis racquet.

In a feature of this aspect, the ball basket is a scoop adapted to be inserted underneath the ball to lift the ball from the ground and adapted to cradle the ball until the ball is tossed into the air.

The present invention according to a eighth aspect is a multi-purpose tennis racquet implement, that may be carried by a user in one or both hands, for lifting, tossing and striking a ball in such a way that the ball does not come in contact with the user's hands, including: a tennis racquet; and a ball basket attached to the distal end of the barrel and adapted to lift a ball from the ground; wherein a user may grasp a handle portion of the tennis racquet, lift the ball from the ground with the ball basket, and without touching the ball with either of the user's hands, toss the ball from the ball basket into the air such that it may be struck by the striking portion of the tennis racquet.

In a feature of this aspect, the ball basket is a scoop adapted to be inserted underneath the ball to lift the ball from the ground and adapted to cradle the ball until the ball is tossed into the air.

The present invention according to a ninth aspect is a method of lifting, tossing and striking a ball, including: providing a multi-purpose implement that includes a tennis racquet and a ball basket attached to the tennis racquet and adapted to lift a ball directly from the ground; and without contacting the ball with one's hands, holding the handle portion in one or both hands, maneuvering the ball basket beneath a ball lying on the ground, lifting the ball directly from the ground with the ball basket, tossing the ball from the ball basket into the air, and while the ball is in the air, striking the ball with the striking portion of the tennis racquet.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
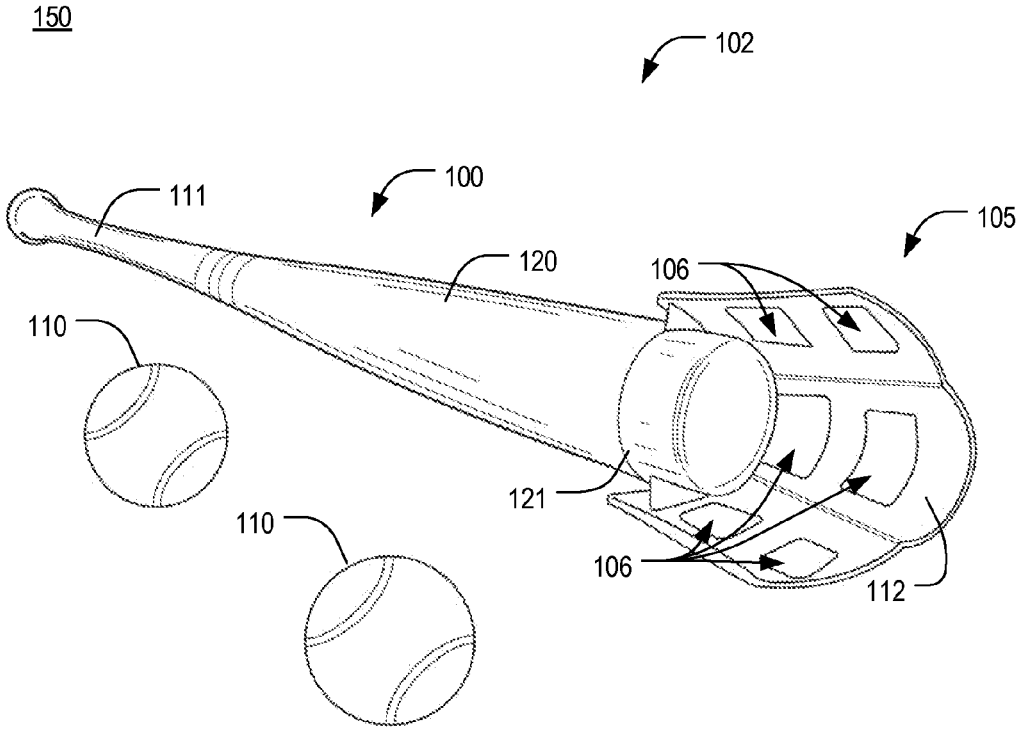
FIG. 1 is a perspective view of a ball lifting, tossing and striking system by which a user can pick up, toss and strike a ball in such a way that the ball does not come in contact with the user's hands, all in accordance with a preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a perspective view of a ball lifting, tossing and striking system 150 by which a user can pick up, toss and strike a ball in such a way that the ball does not come in contact with the user's hands, all in accordance with a preferred embodiment of the present invention. As shown in FIG. 1, the system 150 includes a multi-purpose implement 102 and one or more balls 110. The multi-purpose implement 102 includes a striking implement 100 with a ball basket 105 attached thereto. The striking implement 100, which may be of a generally conventional type, includes a handle portion 111, arranged at a proximal end thereof, and a striking portion 120. In the embodiment of FIG. 1, the ball basket 105 is attached to the striking implement 100 at a distal end thereof.

It will be appreciated that in the embodiment illustrated in FIG. 1, the striking implement 100 has a round cross-section and takes the form of a baseball bat. In other embodiments, the striking portion 120 may have an oval, oblong, octagonal, rectangular, triangular, or any other polygonal shape, including those associated with other exemplary embodiments described and illustrated herein. In one embodiment, the bat is constructed of plastic, but in other embodiments the bat may be constructed of foam, sponge, wood, aluminum, fiberglass, or the like. Some or all of the bat 100 further may be hollow or solid. The ball 110 may be of any type, including a tennis ball, racquetball ball, squash ball, baseball, softball, whiffle ball, cricket ball, or the like, and may be made of any conventional or nonconventional material, including those used for any of the foregoing, sponge, plastic, foam, and the like.

Figure 2:
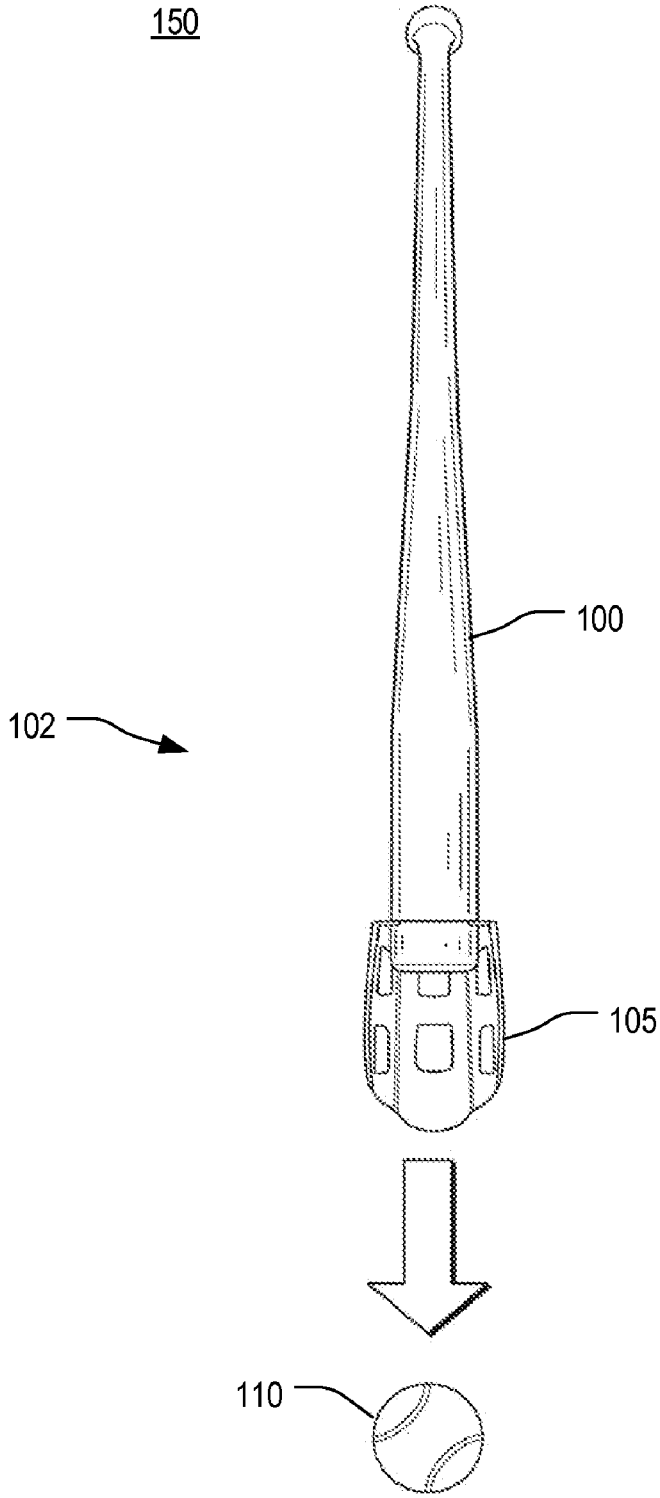
FIG. 2 is a top front perspective view of one of the balls and the multi-purpose implement of FIG. 1.

The ball basket 105 is shown as a scoop which can pick up and cradle or otherwise retain a ball 110. The ball basket 105 is a device to pick up the ball 110 from the ground or any surface or location; however, it will be apparent that the present invention will have many embodiments, some of which are described herein. For example, in one embodiment, the ball basket is in the form of a shovel, while in another embodiment the ball basket is in the form of a press-fit ball grabber, some examples of which may be described and illustrated elsewhere herein. FIG. 2 is a top front perspective view of one of the balls 110 and the multi-purpose implement 102 of FIG. 1. In particular, FIG. 2 illustrates a multi-purpose implement 102 where the ball basket 105 is moving toward the ball 110 with the purpose of scooping the ball 110 from the ground.

In the embodiment illustrated in FIGS. 1 and 2, the ball basket 105 may be permanently attached to the striking implement 100. It will be appreciated, however, that in at least some embodiments, including one or more described elsewhere herein, the ball basket 105 may be removable from the striking implement 100. It will be further appreciated that in at least one embodiment (not illustrated), the ball basket 105 may be attached elsewhere on the striking implement 100, though it is preferred that such attachment not interfere with the user's ability to strike the ball 110 with the striking portion 120 of the implement 100.

In particular, in the embodiment illustrated in FIGS. 1 and 2, the ball basket 105 is permanently attached using a ring 121, integral with the rest of the ball basket 105, encircling the end of the bat. It will be appreciated that in at least one other embodiment the ball basket 105 may be formed integrally with the striking implement 100 in such a manner to provide a seamless connection between the ball basket 105 and the striking implement 100, thus creating a seamless multi-purpose implement 102.

Figure 3:
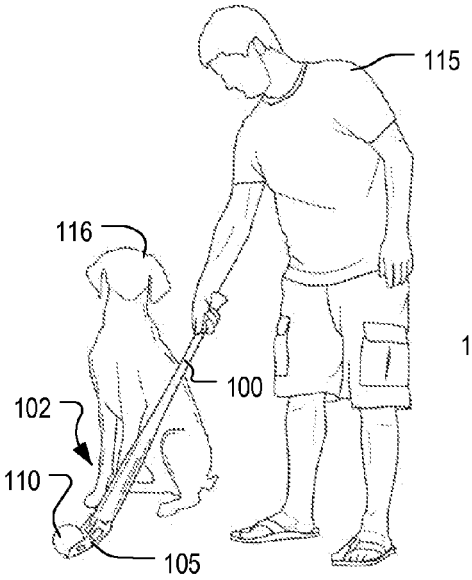
FIG. 3 is an environmental view of a user retrieving or picking up a ball with the multi-purpose implement of FIG. 1.
Figure 4:
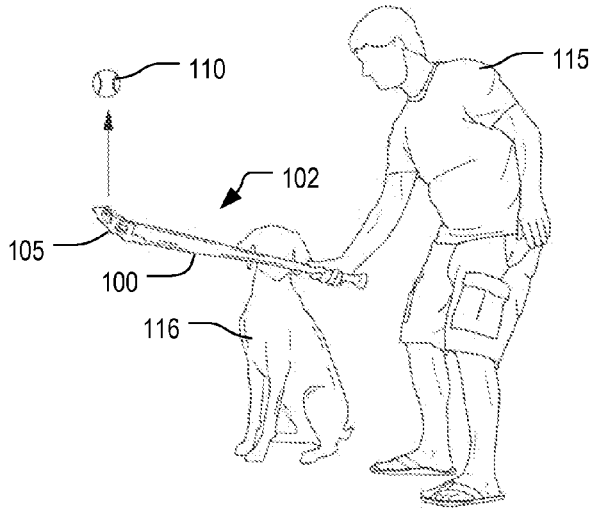
FIG. 4 is an environmental view of a user tossing a ball with the multi-purpose implement of FIG. 1.
Figure 5:
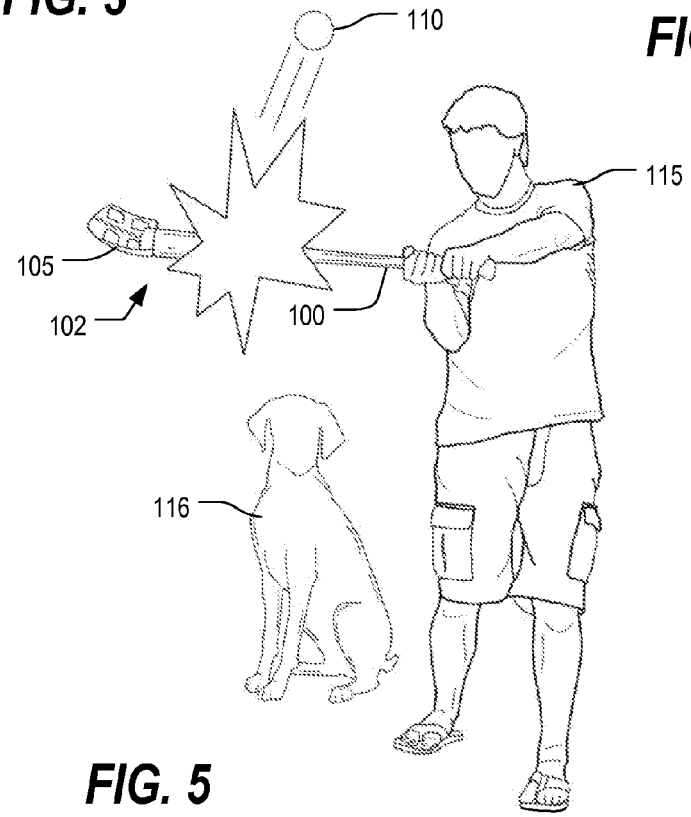
FIG. 5 is an environmental view of a user striking a ball with the multi-purpose implement of FIG. 1.

As illustrated in FIGS. 3-5, the multi-purpose implement 102 of FIGS. 1 and 2 may be manipulated by a user 115 to scoop, toss and strike a ball 110, all in such a way that the ball 110 does not come in contact with the user's hands. In particular, FIG. 3 is an environmental view of a user 115 retrieving or picking up a ball 110 with the multi-purpose implement 102 of FIG. 1. The user 115 grips the handle portion 111 of the implement 102 in such a way as to maneuver the ball basket 105 along the ground toward and then underneath a ball 110 lying on the ground. As used herein, the "ground" is understood to include grass, pavement, sand, gravel, a floor surface, or the like. Similarly, the user may also use the implement 102 to maneuver the ball basket 105 underneath a ball 110 floating on, or partially or fully submerged below, a water surface. It will be appreciated that from a generally vertical standing position, the user may not have to bend very far, if at all, to reach the ball 110 while retrieving it.

Next, the user 115 may use the implement 102 to lift and toss the ball 110 in the air. FIG. 4 is an environmental view of a user 115 tossing a ball 110 with the multi-purpose implement 102 of FIG. 1. The open end of the scoop 105 enables the user 115 to flip the multi-purpose implement 102, ejecting the ball 110 from the ball basket 105 and propelling it upward. In this way the ball 110 may be propelled upward a desired distance, from a few inches or feet upward to height above the head of the user 115.

With the ball 110 in the air, the user 115 may then use the implement 102 to strike the ball 110, thus propelling it, in many cases, a substantial distance from the user 115. FIG. 5 is an environmental view of a user 115 striking a ball 110 with the multi-purpose implement 102 of FIG. 1. Typically, the user waits until the ball 110 reaches the apex of its ejection path and, under the force of gravity, begins descending toward the ground. While the ball 110 is descending, the user 115 hits the ball 110 with the striking implement 100, as shown in FIG. 5. Upon contact with the striking implement 100, the ball 110 travels in the direction the user 115 hits the ball 110.

This ability, for the user 115 to lift, toss and strike the ball 110 without using his or her hands, is particularly beneficial in situations where a user 115 is playing fetch with a dog 116, when the ground or ball 110 is wet or dirty, or during baseball training or the like when the user is holding the implement 102 in one hand and his other hand is otherwise occupied. For example, when conducting practice, a baseball coach may find it beneficial to hold or wear a baseball glove on one hand while holding the multi-purpose implement 102 in the other, thereby enabling him to catch thrown baseballs 110 with his glove but to lift baseballs from the ground and to toss and strike them with the same implement 102, all without removing his glove.

Although as illustrated in FIGS. 1-5, the striking implement 100 takes the form of a conventional baseball bat and has a generally circular cross-section, it will be appreciated that the striking implement 100 may take any shape that includes a striking portion sufficient for striking a ball 110 to cause the ball 110 to travel in a desired direction. Thus, in various alternative embodiments, the striking implement 100 may include, but is not limited to, a striking portion in the form of a stick, a cylindrical object, a rod, a bar, a club, a board, a paddle, or a racquet-like object with a woven or mesh area used for striking a ball. One or more of these various embodiments may be described hereinbelow. Furthermore, the striking portion of the striking implement 100 may be constructed out of any material that is sufficient for creating an implement that can strike a ball and send it a desired distance. Various materials for creating various embodiments of the striking implement 100 may include, but are not limited to, plastic, foam, sponge, wood, aluminum, fiberglass, or the like.

Figure 6:
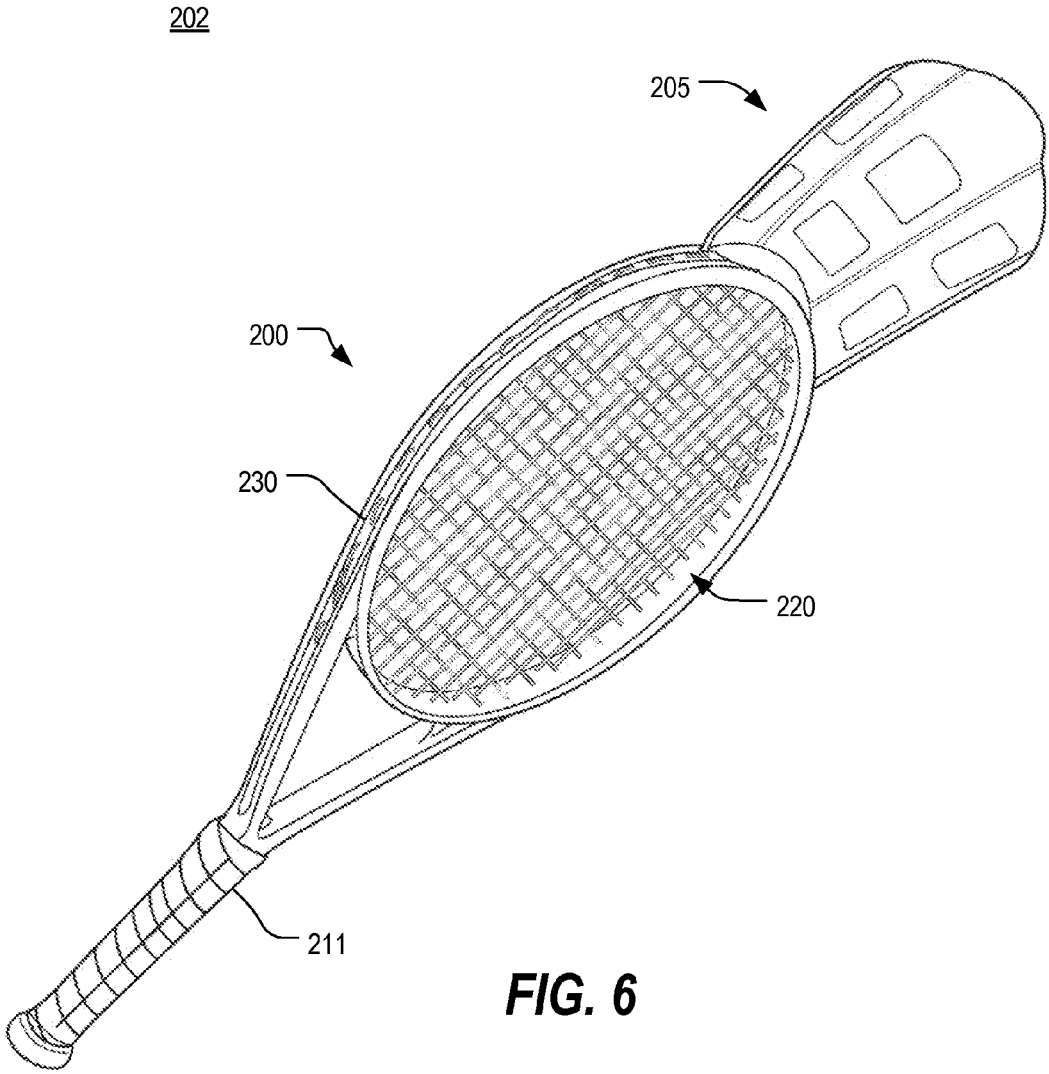
FIG. 6 is a perspective view of a multi-purpose implement in accordance with a second preferred embodiment of the present invention.

FIG. 6 is a perspective view of a multi-purpose implement 202 in accordance with a second preferred embodiment of the present invention. The multi-purpose implement 202 of FIG. 6 includes a striking implement 200 with a ball basket 205 attached thereto. The striking implement 200, which may be of a generally conventional type, includes a handle portion 211, arranged at a proximal end thereof, and a striking portion 220. In the embodiment of FIG. 6, the ball basket 205 is attached to the striking implement 200 at a distal end thereof.

In the embodiment of FIG. 6, the striking implement 200 is a racquet or paddle and the striking portion 220 is a wide planar area. In at least some embodiments, the striking portion 220 of the striking implement 200 may be formed from woven mesh held under tension by a frame 230, such as is conventionally found in a tennis racquet, a racquetball racquet, or the like. In other embodiments, the striking portion is formed from one or more sheets of wood or metal that may or may not be covered by a rubber material or the like, such as is conventionally found in a paddle or the like. In still further embodiments, the striking portion may include a screen, racket, fabric or other flexible sheet material. Further, it will be appreciated that the striking portion 220 may be specifically designed, such as through the use of various materials and design features, to provide additional spring force for hitting the ball 110 with greater force. In at least one embodiment, the racquet handle 211 and frame 230 are constructed of plastic, but in another embodiment the racquet handle 211 and frame 230 are constructed of wood, aluminum, fiberglass, or any conventional tennis racquet or racquetball racquet material.

The ball basket 205 is once again shown as a scoop which can pick up and cradle or otherwise retain a ball 110. The ball basket 205 is a device to pick up the ball 110 from the ground or any surface or location; however, it will be apparent that the present invention will have many embodiments, some of which are described herein.

In the embodiment illustrated in FIG. 6, the ball basket 205 may be permanently attached to the striking implement 200. It will be appreciated, however, that in at least some embodiments, including one or more described elsewhere herein, the ball basket 205 may be removable from the striking implement 200. It will be further appreciated that in at least one embodiment (not illustrated), the ball basket 205 may be attached elsewhere on the striking implement 200, though it is preferred that such attachment not interfere with the user's ability to strike the ball 110 with the striking portion 220 of the implement 200.

In particular, in the embodiment illustrated in FIG. 6, the ball basket 205 is permanently attached directly to one end of the frame 230 of the tennis racquet. It will be appreciated that in at least one other embodiment the ball basket 205 may be formed integrally with the frame of the striking implement 200 in such a manner to provide a seamless connection between the ball basket 205 and the striking implement 200, thus creating a seamless multi-purpose implement 202.

In somewhat similar fashion to that illustrated in FIGS. 3-5, the multi-purpose implement 202 of FIG. 6 may be manipulated by a user 115 to scoop, toss and strike a ball 110, all in such a way that the ball 110 does not come in contact with the user's hands. In particular, the user 115 grips the handle portion 211 of the multi-purpose implement 202 in such a way as to maneuver the ball basket 205 along the ground toward and then underneath a ball 110 lying on the ground. Next, the user 115 may use the implement 202 to lift and toss the ball 110 in the air. The open end of the scoop 205 enables the user 115 to flip the multi-purpose implement 202, ejecting the ball 110 from the ball basket 205 and propelling it upward. In this way the ball 110 may be propelled upward a desired distance, from a few inches or feet upward to a height above the head of the user 115. With the ball 110 in the air, the user 115 may then use the implement 202 to strike the ball 110. Typically, the user waits until the ball 110 reaches the apex of its ejection path and, under the force of gravity, begins descending toward the ground. While the ball 110 is descending, the user 115 hits the ball 110 with the striking implement 200. Upon contact with the striking implement 200, the ball 110 travels in the direction the user 115 hits the ball 110. Depending upon how hard the ball 110 is struck, it may travel a substantial distance from the user 115.

It will be appreciated that the user may not have to bend very far, if at all, to touch the ball 110 or the ground while retrieving the ball 110. Furthermore, the user 115 is able to pick up, toss and strike the ball without using his her hands. This ability, for the user 115 to lift, toss and strike the ball 110 without using his or her hands, is particularly beneficial in situations where a user 115 is playing fetch with a dog 116, when the ground or ball 110 is wet or dirty, or when the user is holding the implement 202 in one hand and his other hand is otherwise occupied.

Figure 7:
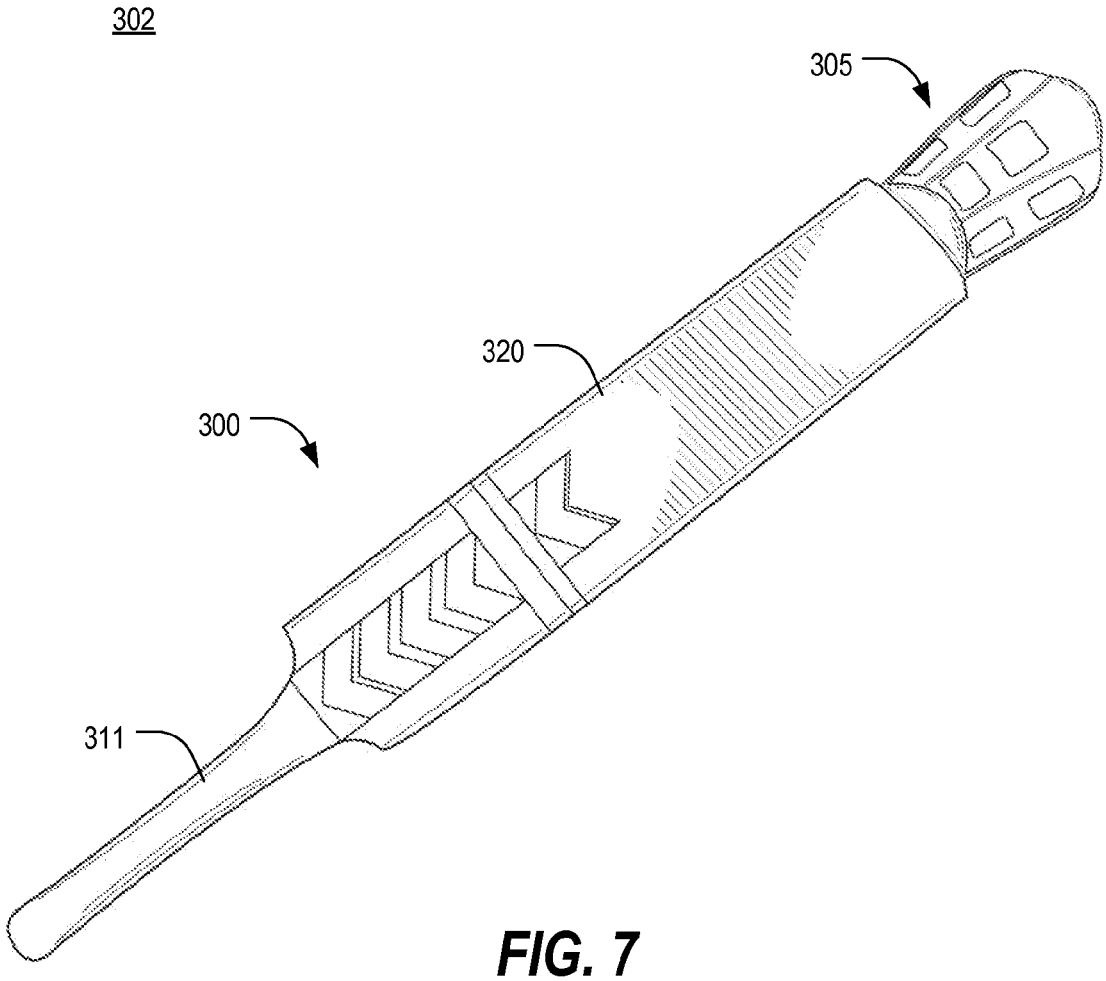
FIG. 7 is a perspective view of a multi-purpose implement in accordance with a third embodiment of the present invention.

FIG. 7 is a perspective view of a multi-purpose implement 302 in accordance with a third preferred embodiment of the present invention. The multi-purpose implement 302 of FIG. 7 includes a striking implement 300 with a ball basket 305 attached thereto. The striking implement 300, which may be of a generally conventional type, includes a handle portion 311, arranged at a proximal end thereof, and a striking portion 320. In the embodiment of FIG. 7, the ball basket 305 is attached to the striking implement 300 at a distal end thereof.

In the embodiment of FIG. 7, the striking implement 300 has a rectangular cross-section 320 in the shape of a cricket bat. In one embodiment the cricket bat striking implement 300 is constructed of plastic, but in another embodiment the cricket bat is constructed of foam, sponge, wood, aluminum, fiberglass, or the like.

The ball basket 305 is once again shown as a scoop which can pick up and cradle or otherwise retain a ball 110. The ball basket 305 is a device to pick up the ball 110 from the ground or any surface or location; however, it will be apparent that the present invention will have many embodiments, some of which are described herein.

In the embodiment illustrated in FIG. 7, the ball basket 305 may be permanently attached to the striking implement 300. It will be appreciated, however, that in another embodiment, including one or more described elsewhere herein, the ball basket 305 may be removable from the striking implement 300. It will be further appreciated that in at least one embodiment (not illustrated), the ball basket 305 may be attached elsewhere on the striking implement 300, though it is preferred that such attachment not interfere with the user's ability to strike the ball 110 with the striking portion of the implement 300.

In particular, in the embodiment illustrated in FIG. 7, the ball basket 305 is permanently attached directly to one end of the paddle portion 320 of the cricket bat. It will be appreciated that in at least one other embodiment the ball basket 305 may be formed integrally with the body of the striking implement 300 in such a manner, such as a one injection tool plastic mold, to provide a seamless connection between the ball basket 305 and the striking implement 300, thus creating a seamless multi-purpose implement 302.

In somewhat similar fashion to that illustrated in FIGS. 3-5, the multi-purpose implement 302 of FIG. 7 may be manipulated by a user 115 to scoop, toss and strike a ball 110, all in such a way that the ball 110 does not come in contact with the user's hands. In particular, the user 115 grips the handle portion 311 of the multi-purpose implement 302 in such a way as to maneuver the ball basket 305 along the ground toward and then underneath a ball 110 lying on the ground. Next, the user 115 may use the implement 302 to lift and toss the ball 110 in the air. The open end of the scoop 305 enables the user 115 to flip the multi-purpose implement 302, ejecting the ball 110 from the ball basket 305 and propelling it upward. In this way the ball 110 may be propelled upward a desired distance, from a few inches or feet upward to a height above the head of the user 115. With the ball 110 in the air, the user 115 may then use the implement 302 to strike the ball 110.

Typically, the user waits until the ball 110 reaches the apex of its ejection path and, under the force of gravity, begins descending toward the ground. While the ball 110 is descending, the user 115 hits the ball 110 with the striking implement 300. Upon contact with the striking implement 300, the ball 110 travels in the direction the user 115 hits the ball 110. Depending upon how hard the ball 110 is struck, it may travel a substantial distance from the user 115.

It will be appreciated that the user may not have to bend very far, if at all, to touch the ball 110 or the ground while retrieving the ball 110. Furthermore, the user 115 is able to pick up, toss and strike the ball without using his her hands. This ability, for the user 115 to lift, toss and strike the ball 110 without using his or her hands, is particularly beneficial in situations where a user 115 is playing fetch with a dog 116, when the ground or ball 110 is wet or dirty, or when the user is holding the implement 302 in one hand and his other hand is otherwise occupied.

Figure 8:
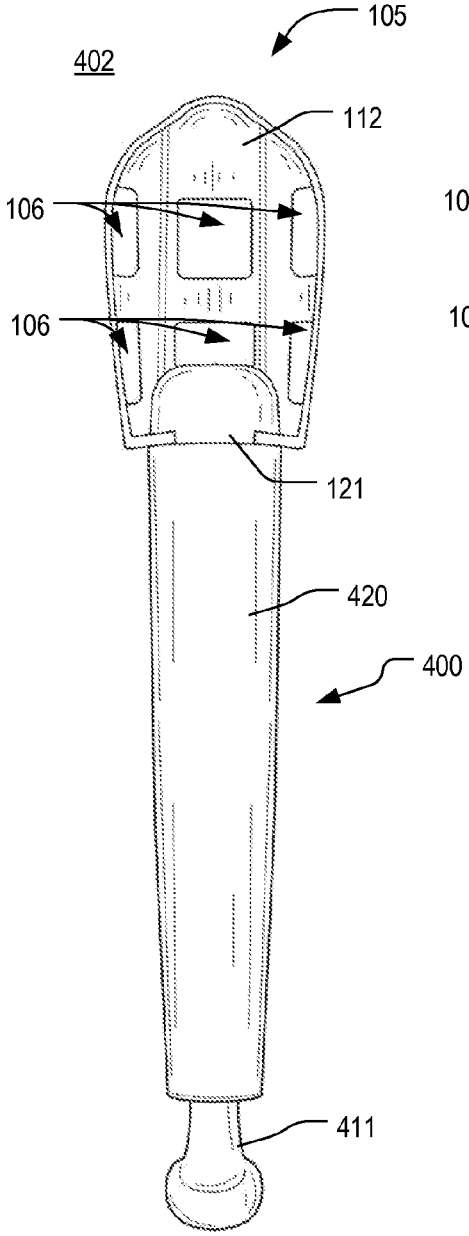
FIG. 8 is a front view of a multi-purpose implement in accordance with a fourth embodiment of the present invention.
Figure 9:
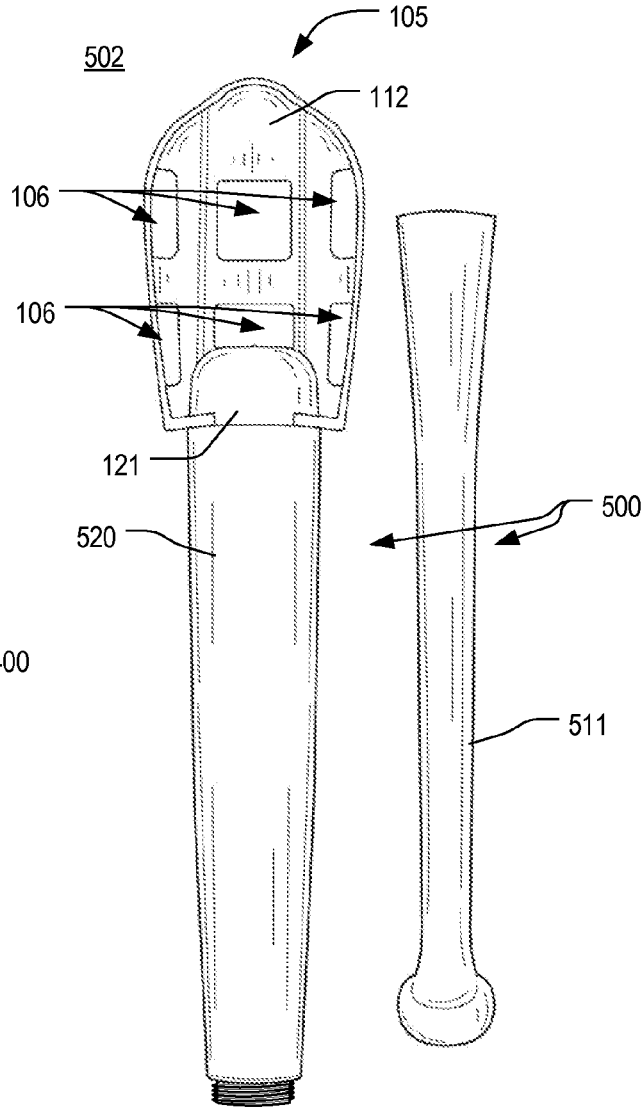
FIG. 9 is a front view of a multi-purpose implement in accordance with a fifth embodiment of the present invention.

FIGS. 8 and 9 are front views of multi-purpose implements 402,502 in accordance with a fourth embodiment and a fifth embodiment, respectively, of the present invention. The multi-purpose implements 402,502 of FIGS. 8 and 9 each include a striking implement 400,500 with a ball basket 105 attached thereto. Each striking implement 400,500 includes a handle portion 411,511 and a striking portion 420,520 that may be arranged, assembled or the like to form a striking implement 400,500 in the form of a baseball bat similar to the one shown in FIG. 1, and the ball basket 105 is attached to the respective striking implement 400,500 at a distal end thereof. However, each respective handle portion 411,511 may be disassembled from its corresponding striking portion 420, 520 for compact storage, transport, shipping or the like. More particularly, in FIG. 8, the handle portion 411 may be telescoped from within the hollow striking portion 420 for use and returned into the striking portion 420 for storage or transport, while in FIG. 9, the handle portion 511 may be attached to the proximal end of the striking portion 520 for use and removed from the striking portion 520 for storage or transport. In some embodiments, the collapsible multi-purpose implements 402,502 of FIGS. 8 and 9 are constructed of plastic, but other embodiments the implements 402,502 may be constructed of foam, sponge, wood, aluminum, fiberglass, or the like.

In the embodiments illustrated in FIG. 8 and FIG. 9, the ball basket 105 is permanently attached to the respective striking implement 400,500. It will be appreciated, however, that in other embodiments the ball basket 105 may be removable from the striking implement 400,500. It will be further appreciated that in still other embodiments (not illustrated), the ball basket 105 may be attached elsewhere on the respective striking implement 400,500, though it is preferred that such attachment not interfere with the user's ability to strike the ball 110 with the striking portion of the implement 200.

In particular, in the embodiments illustrated in FIG. 8 and FIG. 9, the ball basket 105 is permanently attached using a ring 121, integral with the rest of the ball basket 105, encircling the end of the bat. It will be appreciated that in other embodiments the ball basket 105 may be formed integrally with the frame of the striking implement 400,500 in such a manner to provide a seamless connection between the ball basket 105 and the striking implement 400,500, thus creating a seamless multi-purpose implement 402,502.

It will be appreciated that in the embodiments illustrated in FIGS. 1-9, the ball basket 105,205,305 comprises a rounded scoop 112 with six openings 106 to reduce air resistance when tossing a ball 110, to allow dirt, water, or the like to sift through, to make it easier to see a ball 110 cradled therein, and the like. It will be appreciated, however, that in alternative embodiments the ball basket may take any shape that is sufficient for picking up and ejecting a ball 110 into the air.

In the embodiments described thus far, each ball basket 105,205,305 is permanently attached to a respective striking implement. However, as noted previously, in other embodiments of a multi-purpose implement, a ball basket is removably attached to a striking implement. FIG. 10A, for example, is a perspective view of a multi-purpose implement 602, shown in a disassembled state, in accordance with a sixth embodiment of the present invention. The multi-purpose implement 602 of FIG. 10A includes a striking implement 600 with a ball basket 605 that may be attached thereto or removed therefrom as desired. The striking implement 600, which includes a handle portion 211 and a striking portion 220, may be of conventional or nonconventional type, but a particular advantage of this embodiment is that the ball basket 605 may be attached to a conventional striking implement 600 that is acquired separately from the ball basket 605, allowing the user 115 to use his or her own preferred striking implement 600, shift between different striking implements, or the like. In particular, the striking implement 600 of FIG. 10A is a tennis racquet, and the ball basket 605 is particularly adapted to be attached to such racquets via specialized attachment fittings 607.

Figure 10B:
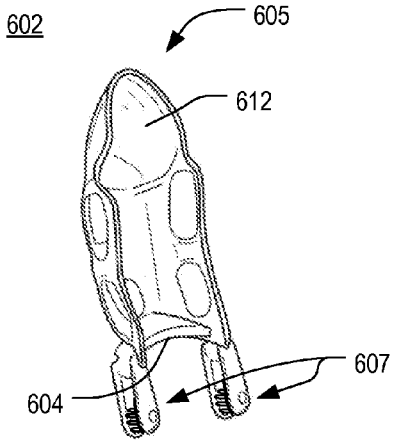
FIG. 10B is a side perspective view of the ball basket of FIG. 10A.
Figure 10B:
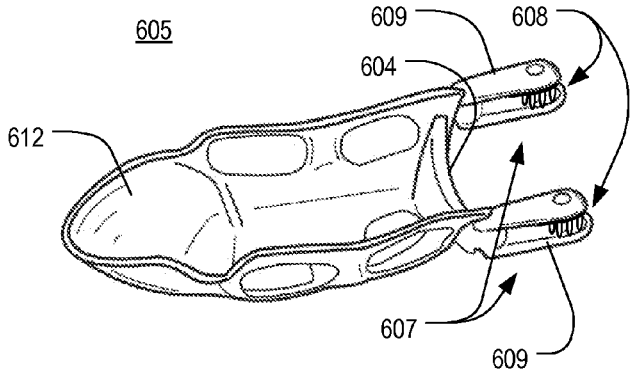
Figure 10A:
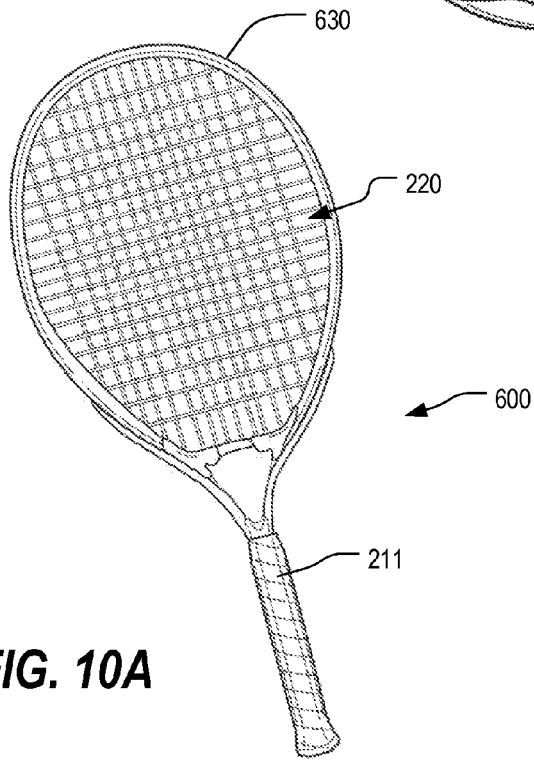
FIG. 10A is a perspective view of a multi-purpose implement, shown in a disassembled state, in accordance with a sixth embodiment of the present invention.

FIG. 10B is a side perspective view of the ball basket 605 of FIG. 10A. The ball basket 605 is once again shown as a scoop 612 which can pick up and cradle or otherwise retain a ball 110. The ball basket 605 is a device to pick up the ball 110 from the ground or any surface or location; however, it will be apparent that the present invention will have many embodiments, some of which are described herein.

The ball basket 605 is attached to the end of a tennis racquet, racquetball racquet, squash racquet, badminton racquet or the like via the attachment fittings 607, of which there are preferably at least two, spaced apart from each other to provide greater stability. As illustrated, each fitting 607 includes two clamp arms 609 between which extend a plurality of bristles 608. To attach the basket 605 to the racquet 600, the clamp arms 609 are flexed slightly and forced over the end of the racquet frame 630. The basket 605 is forced onto the end of the frame 630 until the basket bottom 604 fits snugly against the end of the frame 630. The bristles 608, which are preferably soft-tipped to avoid damaging the woven mesh of the racquet 600, are positioned around individual strings in the mesh, which effectively locks it in place. The bristles 608, are provided in a grid pattern which, when bristles 608 are interlocked between the grid of mesh, secures the basket 605 and fastens the basket 605 in a manner which reduces movement of basket 605 when subjected to lateral forces. The basket 605 is then held in place via the combined effect of the bristles 608 in the mesh and the various tensions and other forces exerted by the elements of the fittings 607 and basket 605. The multi-purpose implement 602 of FIG. 10A may then be used in generally like manner to the implement 202 of FIG. 6.

It will be appreciated that in the embodiment illustrated in FIGS. 10A and 10B, the attachment fitting 607 are two clips that fit over the end of a conventional tennis racquet 600. In another embodiment, the attachment means 607 be one continuous clip that fits over the end of a conventional tennis racquet, more than two clips, or any other means by which attaching a ball basket 605 enables a user 115 to scoop, toss, and strike a ball in such a way that the ball does not come in contact with a user's hands. Further, in at least some embodiments, screws, bolts, spring held clips or arms (similar to a woman's hair clip) or the like may be used to provide greater retention forces.

Figure 11:
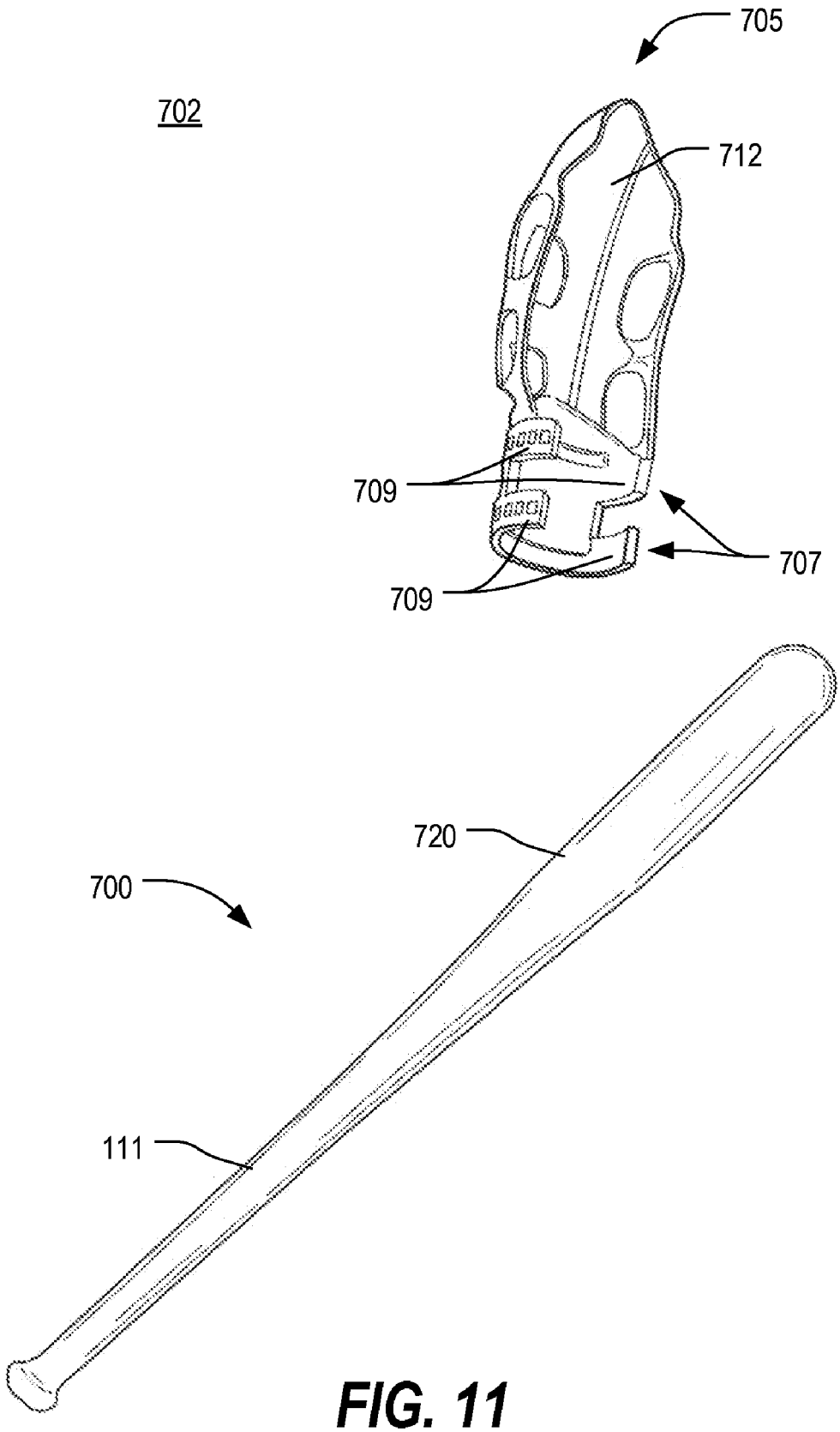
FIG. 11 is a perspective view of a multi-purpose implement, shown in a disassembled state, in accordance with a seventh embodiment of the present invention.

FIG. 11 is a perspective view of a multi-purpose implement 702, shown in a disassembled state, in accordance with a seventh embodiment of the present invention. The multi-purpose implement 702 of FIG. 11 includes a striking implement 700 with a ball basket 705 that may be attached thereto or removed therefrom as desired. The striking implement 700, which includes a handle portion 111 and a striking portion 720, may be of conventional or nonconventional type, but a particular advantage of this embodiment is that the ball basket 705 may be attached to a conventional striking implement 700 that is acquired separately from the ball basket 705, thus saving money for the user 115, allowing the user 115 to use his or her own preferred striking implement 700, or the like. In particular, the striking implement 702 of FIG. 11 is a baseball or softball bat, and the ball basket 705 is particularly adapted to be attached to such bats via specialized attachment fittings 707.

The ball basket 705 is once again shown as a scoop 712 which can pick up and cradle or otherwise retain a ball 110. The ball basket 705 is a device to pick up the ball 110 from the ground or any surface or location; however, it will be apparent that the present invention will have many embodiments, some of which are described herein. The ball basket 705 is attached to the end of a baseball bat, softball bat or the like via the attachment fittings 707, of which there are preferably a pair, spaced apart from each other to provide greater stability. As illustrated, each fitting 707 includes a half-ring 709 that wraps around the barrel end of the bat 700. To attach the basket 705 to the bat 700, the half-rings 709 are flexed slightly and forced over the end of the bat 700. The scoop 712 is positioned just beyond the end of the bat 700. The basket 705 is then held in place via the clamping effect of the half-rings 709 on the end of the bat 700. The multi-purpose implement 702 of FIG. 11 may then be used in generally like manner to the implement 102 of FIGS. 1-5.

It will be appreciated that in the embodiment illustrated in FIG. 11, the specialized attachment fitting 707 comprises two half rings that fit over the end of a conventional bat. In another embodiment, the attachment fitting 707 be one continuous ring that fits over the end of a conventional bat 700, more than two half rings, or any other means by which attaching a ball basket 705 enables a user 115 to scoop, toss, and strike a ball in such a way that the ball does not come in contact with a user's hands. Further, in at least some embodiments, a strap, wire, Velcro®, fasteners or the like (not shown) may be wrapped around one or more of the half rings to draw their ends closer together, thereby increasing the clamping forces applied around the end of the bat. Such a strap, wire or the like may be built into the attachment fitting 707 or applied separately.

Figure 12A:
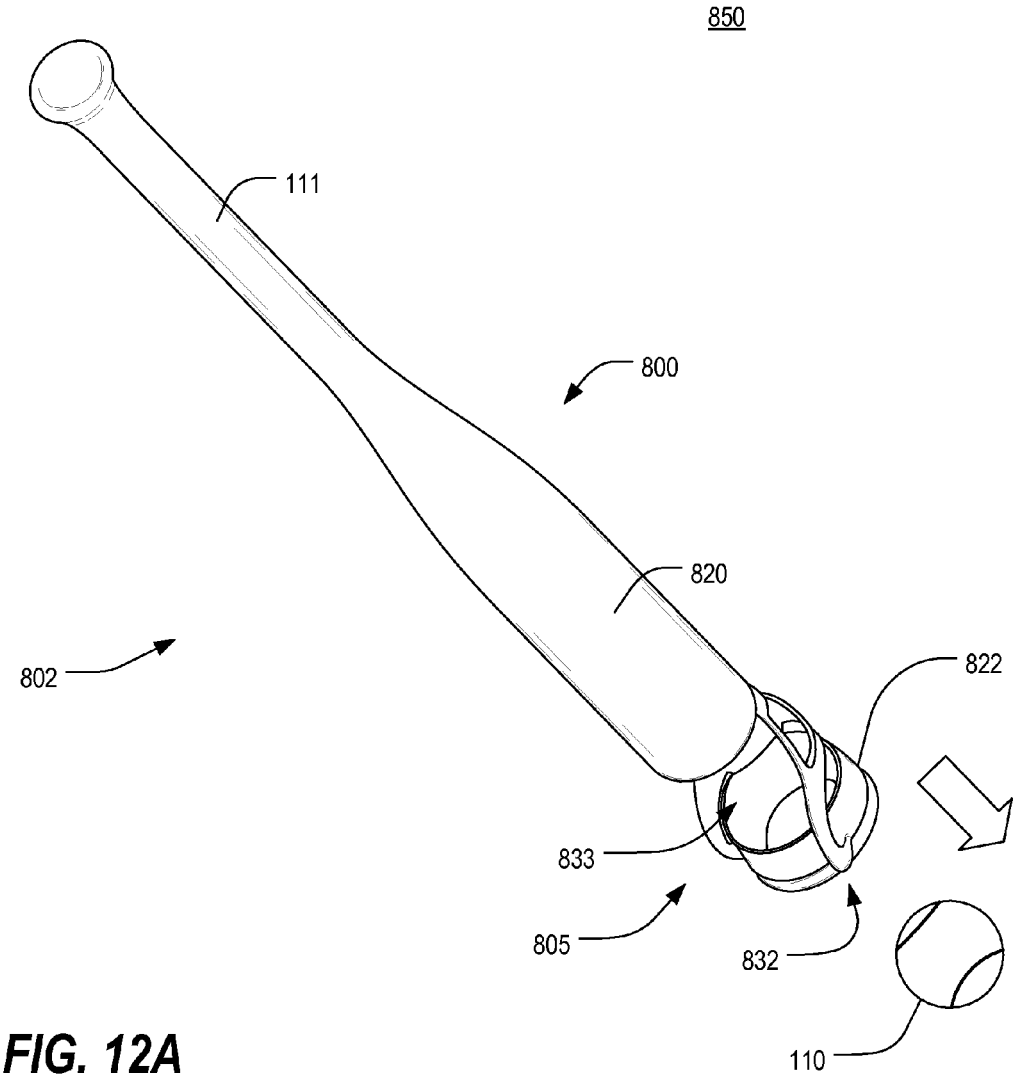
FIG. 12A is a perspective view of a ball lifting, tossing and striking system by which a user can pick up, toss and strike a ball in such a way that the ball does not come in contact with the user's hands, all in accordance with an eighth embodiment of the present invention.
Figure 12B:
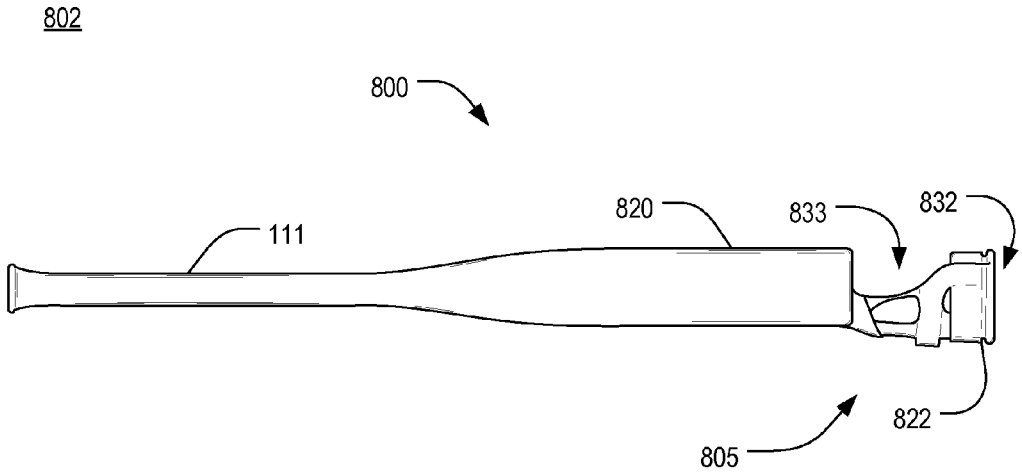
FIG. 12B is a side view of the multi-purpose implement of FIG. 12A.
Figure 12C:
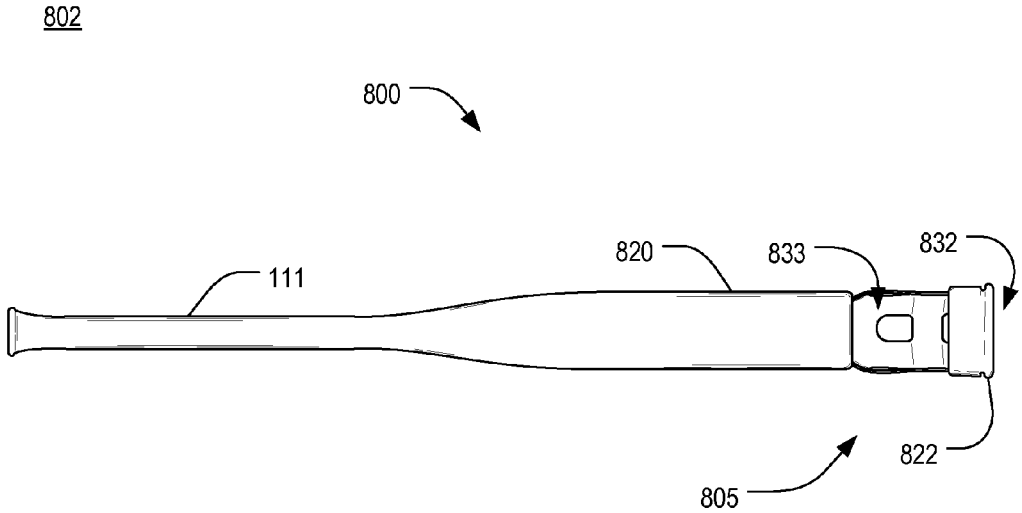
FIG. 12C is a front view of the multi-purpose implement of FIG. 12A.

FIG. 12A is a perspective view of a ball lifting, tossing and striking system 850 by which a user can pick up, toss and strike a ball in such a way that the ball does not come in contact with the user's hands, and FIGS. 12B and 12C are a side view and a front view, respectively, of the multi-purpose implement 802 of FIG. 12A, all in accordance with an eighth embodiment of the present invention. As with the system 150 of FIG. 1, this system 850 includes a multi-purpose implement 802 and one or more balls 110, and the multi-purpose implement 802 includes a striking implement 800 with a ball basket 805 attached thereto. The striking implement 800, which may be of a generally conventional type, includes a handle portion 111, arranged at a proximal end thereof, and a striking portion 820. In the embodiment of FIGS. 12A-12C, the ball basket 805 is attached to the striking implement 800 at a distal end thereof.

In particular, FIGS. 12A-12C illustrate a system 850 where the ball basket 805 is a press-fit ball grabber that has a ring-shaped end 822, defining a ball inlet 832, which snaps around a ball 110 for the purpose of picking up the ball 110 from the ground. In at least one embodiment, the ring-shaped end 822 is constructed from a conventional plastic material or the like which expands slightly as the user pushes or presses the striking implement 800 onto the ball 110. Also in at least one embodiment, the ball 810 is constructed of soft rubber or like material and is compressible, and the ring-shaped end 822 is sufficiently rigid to compress the ball 110 slightly as the user pushes the striking implement 800 onto the ball 110. The ball basket 805 further defines a ball outlet 833 on a side thereof. In use, the user holds the striking implement 800 over the ball 110 in an orientation that is generally perpendicular to the ground and presses the ring-shaped end 822 directly over the ball 110. The force of the ball 110, pushing up through the structure of the ring-shaped end 822, expands the ring structure enough to allow the ball 110 to snap through the inlet 832 into the ball basket 805. Once the ball 110 is within the basket 805, it is retained there because the weight of the ball 110 is insufficient to force the ball 110 back through the inlet 832. However, by shifting the implement 802 toward amore horizontal (rather than perpendicular) orientation relative to the ground and, in conjunction therewith, rotating the implement 802, and thus the ball basket 805, such that the ball outlet 833 is oriented upward (away from the ground), the user may then manipulate the implement 802 to flip or toss the ball 110 upward, in like manner to that previously described and particularly with regard to FIGS. 4 and 5. The ball 110 is then ejected through the open outlet 833 of the ball basket 805 and propelled upward, whereupon the user 115 can swing the striking implement 800 and hit the ball 110 out of the air.

In the embodiment illustrated in FIGS. 12A-12C, the ball basket 805 is permanently attached to the distal end of the striking implement 800. It will be appreciated that in another embodiment the ball basket 805 may be formed by using one continuous piece of material to create the striking implement 800 and the ball basket 805 in such a manner to provide a seamless connection between the ball basket 805 and the striking implement 800, thus creating a seamless multi-purpose implement 802. In still another embodiment, the ball basket 805 may be removable from the striking implement 800. In one embodiment the ball basket 805 is constructed of plastic, but in another embodiment the ball basket 805 is constructed of foam, sponge, wood, aluminum, fiberglass, or the like.

Figure 13:
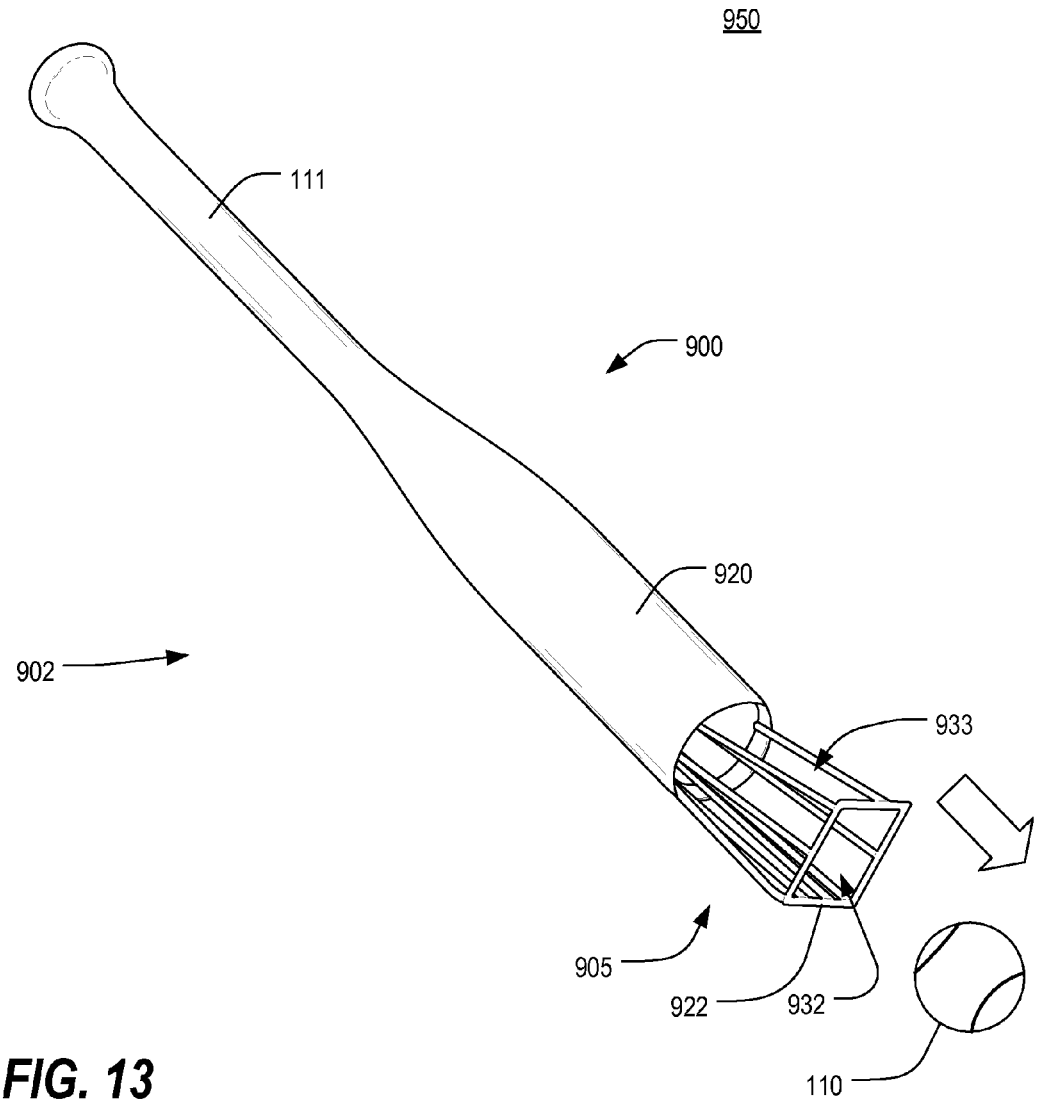
FIG. 13 is a perspective view of a ball lifting, tossing and striking system by which a user can pick up, toss and strike a ball in such a way that the ball does not come in contact with the user's hands, all in accordance with a ninth embodiment of the present invention.
Figure 14:
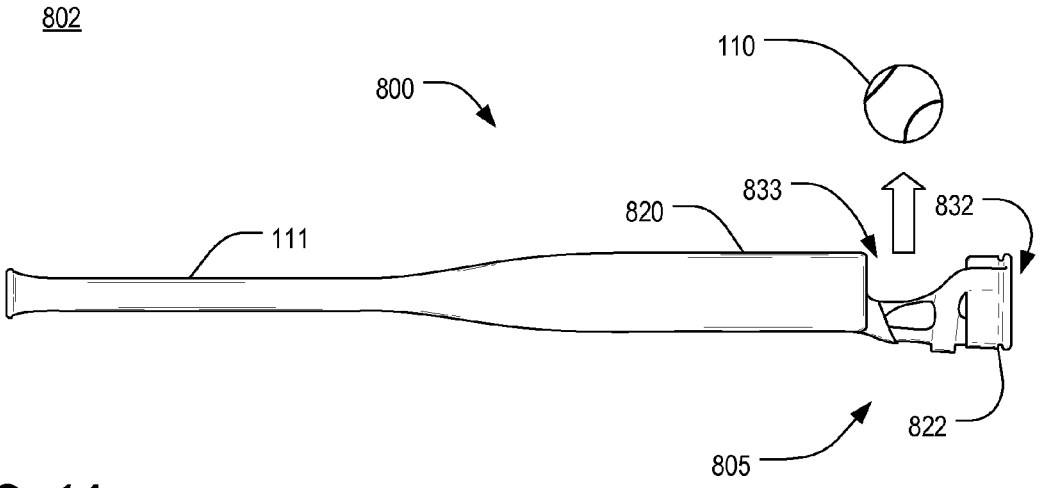
FIG. 14 is a side view of the multi-purpose implement of FIG. 12A, showing a ball exiting the ball outlet.
Figure 15:
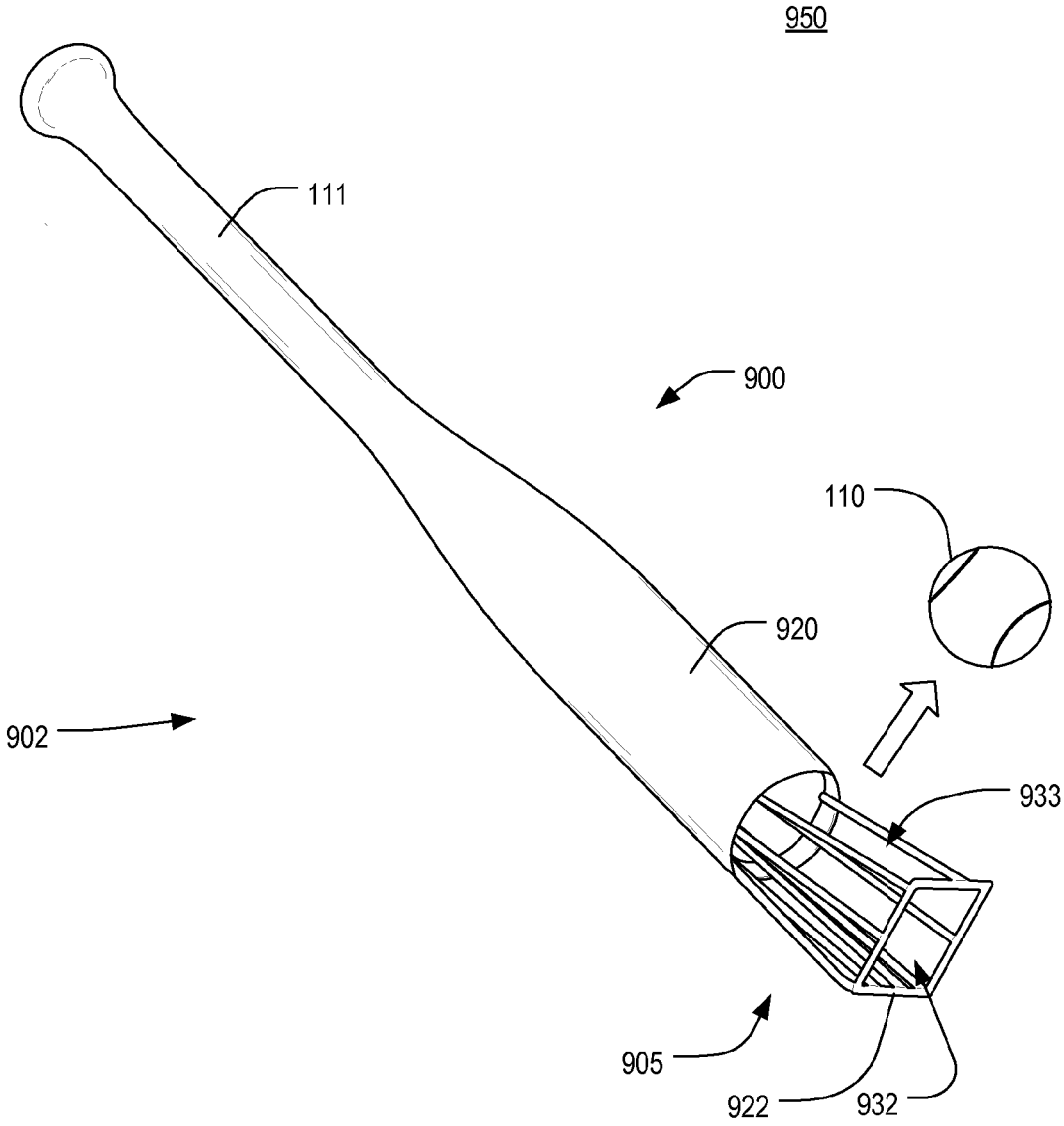
FIG. 15 is a perspective view of the system of FIG. 13, showing a ball exiting the ball outlet.

FIG. 13 is a perspective view of a ball lifting, tossing and striking system 950 by which a user can pick up, toss and strike a ball in such a way that the ball does not come in contact with the user's hands, all in accordance with a ninth embodiment of the present invention. As with the system 150 of FIG. 1, this system 950 includes a multi-purpose implement 902 and one or more balls 110, and the multi-purpose implement 902 includes a striking implement 900 with a ball basket 905 attached thereto. The striking implement 900, which may be of a generally conventional type, includes a handle portion 111, arranged at a proximal end thereof, and a striking portion 920. In the embodiment of FIG. 13, the ball basket 905 is attached to the striking implement 900 at a distal end thereof.

In particular, FIG. 13 illustrates a system 950 where the ball basket 905 is a press-fit ball grabber that has a square-shaped end 922, defining a ball inlet 932, which snaps around a ball 910 for the purpose of picking up the ball 910 from the ground. In at least one embodiment, the ball 910 is constructed of soft rubber or like material and is compressible, and the square-shaped end 922 is formed from rigid material such as heavy-gauge wire or the like and is sufficiently rigid to compress the ball 110 slightly as the user pushes the striking implement 900 onto the ball 110. Also in at least one embodiment, the square-shaped end 922 is constructed from a conventional plastic material or the like which expands slightly as the user pushes or presses the striking implement 900 onto the ball 110. The ball basket 905 further defines a ball outlet 933 on a side thereof. In use, the user holds the striking implement 900 over the ball 110 in an orientation that is generally perpendicular to the ground and presses the square-shaped end 922 directly over the ball 910. The force of the square-shaped end 922 pushing down on the ball 910 compresses the ball 910 enough to allow the ball 110 to snap through the inlet 932 into the ball basket 905. Once the ball 110 is within the basket 905, it is retained there because the weight of the ball 110 is insufficient to force the ball 110 back through the inlet 932. However, by shifting the implement 902 toward a more horizontal (rather than perpendicular) orientation relative to the ground and, in conjunction therewith, rotating the implement 902, and thus the ball basket 905, such that the ball outlet 933 is oriented upward (away from the ground), the user may then manipulate the implement 902 to flip or toss the ball 110 upward, in like manner to that previously described and particularly with regard to FIGS. 4 and 5. The ball 910 is then ejected through the open outlet 933 of the ball basket 905 and propelled upward, whereupon the user 115 can swing the striking implement 900 and hit the ball 910 out of the air.

In the embodiment illustrated in FIG. 13, the ball basket 905 is permanently attached to the end of the striking implement 900. In another embodiment, the ball basket 905 may be removable from the striking implement 900. In one embodiment the ball basket 905 is constructed of plastic- or rubber-coated metal, but in other embodiments the ball basket 905 is constructed of bare metal, plastic, foam, sponge, wood, aluminum, fiberglass, or the like.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A ball lifting, tossing and striking system by which a user can pick up, toss and strike a ball in such a way that the ball does not come in contact with the user's hands, comprising:

(a) a ball; and (b) a multi-purpose implement that may be carried by a user in one or both hands, including:

(i) a striking implement, including a handle portion and a striking portion, defining a longitudinal axis and including a proximal end and a distal end, (ii) a press-fit ball inlet, arranged in the distal end of the striking implement and oriented perpendicularly to the longitudinal axis of the striking implement, and (iii) a ball outlet, arranged along a side of the striking implement and oriented generally perpendicular to the ball inlet;

(c) wherein a user may grasp the handle portion, hold the multi-purpose implement over the ball, when the ball is resting on a surface, in an orientation that is generally perpendicular to a surface, press the ball inlet directly over the ball to receive the ball into the striking implement, and lift the ball from the surface with the striking implement, and without touching the ball with either of the user's hands, toss the ball from the striking implement via the ball outlet such that it may be struck by the striking portion.

2. The system of claim 1, wherein the ball inlet and the ball outlet are implemented in a ball basket.

3. The system of claim 2, wherein the striking implement, including the ball basket is formed using one continuous piece of material thereby providing a seamless connection between the ball basket and the striking portion.

4. The system of claim 2, wherein the striking portion has a round cross-section.

5. The system of claim 4, wherein the handle portion and the striking portion together take a form of a bat.

6. The system of claim 2, wherein the striking implement is at least partially constructed of plastic.

7. The system of claim 2, wherein the ball is a tennis ball.

8. The system of claim 2, wherein the ball basket is a press-fit ball grabber adapted to be pressed onto the ball to lift the ball from the surface and adapted to cradle the ball until the ball is tossed aloft.

9. The system of claim 5, wherein the press-fit ball inlet includes a ring-shaped end defining the ball inlet.

10. The system of claim 9, wherein the ring-shaped end snaps around the ball for a purpose of picking up the ball from the surface.

11. The system of claim 8, wherein the ball outlet is defined in the side of the ball basket.

12. The system of claim 11, wherein the ball basket is arranged to permit the ball to be tossed upward through the ball outlet by the user.

13. The system of claim 2, wherein at least a portion of the striking portion is hollow.

14. The system of claim 1, wherein an interior compartment is defined within the striking implement near the distal end thereof such that the ball may enter the interior compartment via the ball inlet and may exit the interior compartment via the ball outlet.

15. A multi-purpose implement that may be carried by a user in one or both hands, for lifting, tossing and striking a ball in such a way that the ball does not come in contact with the user's hands, comprising:

(a) a striking portion having a proximal end and a distal end;

(b) a handle portion disposed at the proximal end of the striking portion; and (c) a ball basket with a press-fit ball grabber having a ring-shaped end defining a ball inlet and a side defining a ball outlet, disposed at the distal end of the striking portion and adapted to lift a ball from a surface;

(d) wherein the press-fit ball grabber includes an end that snaps around the ball for a purpose of picking up the ball from the surface; and (e) wherein the striking portion, handle portion and ball basket define a multi-purpose implement, and wherein a user may grasp the handle portion, hold the implement over the ball in an orientation that is generally perpendicular to the surface, press the ring-shaped end directly over the ball to receive the ball into the ball basket, and lift the ball from the surface with the ball basket, and without touching the ball with either of the user's hands, toss the ball from the ball basket via the ball outlet such that it may be struck by the striking portion.

16. The system of claim 15, wherein the striking implement, including the ball basket is formed with striking portion using one continuous piece of material thereby providing a seamless connection between the ball basket and the striking portion.

17. The system of claim 15, wherein an interior compartment is defined within the ball basket such that the ball may enter the interior compartment via the ball inlet and may exit the interior compartment via the ball outlet.

18. A method of lifting, tossing and striking a ball, comprising:

(a) providing a multi-purpose implement, including:

(i) a bat, having a handle portion and a striking portion, (ii) a press-fit ball inlet, arranged in a distal end of the bat and oriented perpendicularly to a longitudinal axis of the bat, and (iii) a ball outlet arranged along a side of the bat; and (b) without contacting a ball with one's hands:

(i) holding the handle portion in one or both hands, (ii) maneuvering the press-fit ball inlet over the ball, when the ball is resting on a surface, in an orientation that is generally perpendicular to the surface;

(iii) pressing the distal end directly over the ball, allowing the ball to snap through the inlet and into an interior compartment;

(iv) lifting the ball from the surface using the multi-purpose implement;

(v) tossing the ball from the interior compartment aloft, via the ball outlet; and (vi) while the ball is aloft, striking the ball with the striking portion.

* * * * *